US012098600B2

(12) United States Patent
Quero et al.

(10) Patent No.: US 12,098,600 B2
(45) Date of Patent: Sep. 24, 2024

(54) SPLIT REEL AND HANDLER SYSTEM

(71) Applicant: Halliburton Energy Services, Inc., Houston, TX (US)

(72) Inventors: Philippe Quero, Houston, TX (US); Eric Bivens, Littleton, CO (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/378,510

(22) Filed: Oct. 10, 2023

(65) Prior Publication Data

US 2024/0035345 A1 Feb. 1, 2024

Related U.S. Application Data

(63) Continuation of application No. 17/049,298, filed as application No. PCT/US2019/064533 on Dec. 4, 2019, now Pat. No. 11,821,270.

(51) Int. Cl.

| | |
|---|---|
| ***E21B 19/00*** | (2006.01) |
| ***B65H 75/14*** | (2006.01) |
| ***B65H 75/44*** | (2006.01) |
| ***E21B 17/20*** | (2006.01) |
| ***E21B 19/22*** | (2006.01) |

(52) U.S. Cl.

CPC ..... *E21B 19/008* (2013.01); *B65H 75/146* (2013.01); *B65H 75/4407* (2013.01); *E21B 17/20* (2013.01); *E21B 19/22* (2013.01)

(58) Field of Classification Search

CPC ..... E21B 19/008; E21B 19/22; B65H 75/14; B65H 75/146; B65H 75/4407

See application file for complete search history.

(56) References Cited

U.S. PATENT DOCUMENTS 3,766,996 A * 10/1973 Moody ..... E21B 19/084 173/147
4,476,945 A * 10/1984 Hearn ..... E21B 19/22 175/203
6,264,128 B1 * 7/2001 Shampine ..... B65H 75/425 242/157.1
6,530,432 B2 * 3/2003 Gipson ..... E21B 19/22 242/397.2

(Continued)

FOREIGN PATENT DOCUMENTS

EP 1985567 A2 10/2008

OTHER PUBLICATIONS

International Search Report and Written Opinion of PCT/US2019/064533 mailed Sep. 1, 2020.

*Primary Examiner* — Matthew R Buck
(74) *Attorney, Agent, or Firm* — NOVAK DRUCE CARROLL LLP

(57) ABSTRACT

A reel assembly is provided. The reel assembly includes a housing, a drum core disposed within the housing, and a splitter flange separating the drum core into a first partition and a second partition. A first conduit is wound on the first partition of the drum core, and a second conduit is wound on the second partition of the drum core. A conduit handler system is utilized to make a connection or test a connection between the first conduit and the second conduit using actuating pistons to apply a compressive or an opposing tensile force on the connection.

20 Claims, 7 Drawing Sheets

(56) References Cited

U.S. PATENT DOCUMENTS

| | | | | |
|---|---|---|---|---|
| 2003/0006034 | A1* | 1/2003 | Neal | B65H 75/4402 166/384 |
| 2005/0023404 | A1* | 2/2005 | Hill | E21B 19/22 242/407 |
| 2008/0265081 | A1* | 10/2008 | Laun | B65H 75/4405 242/397.3 |
| 2010/0096124 | A1* | 4/2010 | Naumann | E21B 17/206 166/85.1 |
| 2010/0314132 | A1* | 12/2010 | Coles | E21B 19/22 166/77.2 |
| 2013/0020271 | A1* | 1/2013 | Nero | B66D 1/30 211/85.5 |
| 2019/0292008 | A1* | 9/2019 | Mazarac | E21B 19/008 |

* cited by examiner

SPLIT REEL AND HANDLER SYSTEM

CROSS-REFERENCE TO RELATED APPLICATIONS

This application is a continuation of U.S. Non-Provisional application Ser. No. 17/049,298 filed Oct. 20, 2020, which claims benefit to PCT Application No. PCT/US2019/064533 filed Dec. 4, 2019, which are incorporated herein by reference.

TECHNICAL FIELD

The present disclosure relates generally to reels used in wellhead systems. In at least one example, the present disclosure relates to a split reel and conduit handling system.

BACKGROUND

Wellbores are drilled into the earth for a variety of purposes including accessing hydrocarbon bearing formations. In conventional wells for the production of hydrocarbons, one or more cylindrical casings surround a smaller diameter production tubing through which the hydrocarbons will flow to the wellhead. Production tubing may utilize coiled tubing that is stored on a reel and installed or removed from the well using an injector.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
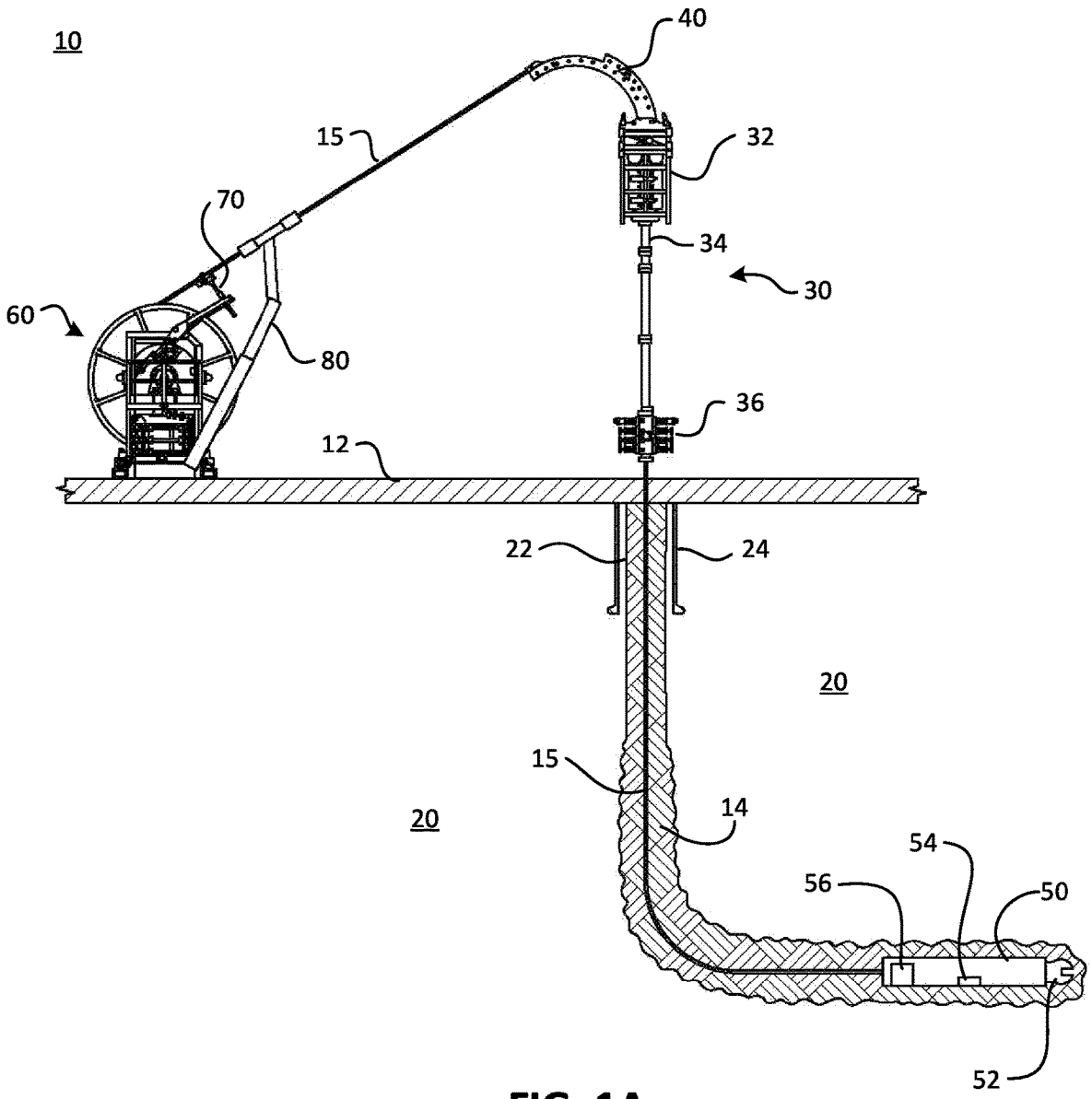
FIG. 1A is a diagram illustrating an exemplary environment for a wellhead utilizing a split reel and conduit handling system, in accordance with various aspects of the subject technology.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, not all of the details may be necessary to practice the disclosed examples. In other instances, methods, procedures and components have been described so as not to obscure the related relevant feature being described. Also, the description is not to be considered as limiting the scope of the examples described herein. The drawings are not necessarily to scale and the proportions of certain parts may be exaggerated to better illustrate details and features.

Disclosed herein is a reel assembly that includes a splitter flange which separates a drum core into a first partition and a second partition. A first conduit can be wound on the first partition of the drum core, and a second conduit can be wound on the second partition of the drum core. With such a configuration, the housing of the reel assembly can contain at least two different and separate conduits. Accordingly, only one reel assembly is needed to be on site, which can create ease of transportation and storage. Additionally, the conduits can be inserted into wellbores without needing to adjust the guide arch, as the angle and originating location of the conduits are substantially the same. For example, a first conduit may be needed for a section of the well that has a first diameter, while a second conduit with a smaller diameter may be needed for a section of the well that has a smaller, second diameter. The first conduit can be wound on the first partition of the drum core while the second conduit can be wound on the second partition of the drum core. The first conduit can be inserted into the well, and when the second conduit is needed, the reel assembly can be adjusted so that the second conduit is then inserted into the well, without needing to pull from different reel assemblies.

FIG. 1A is a diagram illustrating an exemplary environment 10 for a wellhead 30 utilizing a split reel 60 and conduit handling system 80, in accordance with various aspects of the subject technology. The exemplary environment 10 includes a wellhead 30 disposed on a surface 12 extending over and around a wellbore 14. The wellbore 14 is within an earth formation 20 and, in at least one example, can have a casing 22 lining the wellbore 14. The casing 22 can be held into place by cement 24. In at least one example, the conduit 15 can be at least partially made of an electrically conductive material, for example steel. In another example, the conduit 15 can be at least partially made of a non-electrically conductive material, for example fiberglass or PEEK, or of a low-conductivity material, for example carbon composite, or a combination of such materials. A downhole tool 50 can be disposed within the wellbore 14 and moved down the wellbore 14 via a conduit 15 to a desired location. The conduit 15 may be coiled tubing. In other examples, the conduit 15 can be, for example, tubingconveyed via a wireline, slickline, work string, joint tubing, jointed pipe, pipeline, and/or any other suitable means. The downhole tool 50 can include, for example, downhole sensors, chokes, and valves. The chokes and valves may include actuatable flow regulation devices, such as variable chokes and valves, and may be used to regulate the flow of the fluids into and/or out of the conduit 15. The downhole tool 50 also includes a drill tool 52 to drill the wellbore 14 in the formation 20. For example, the drill tool 52 can include a drill bit, a mill, and/or an auger. One or more assembly sensors 54 can be disposed in the downhole tool 50 and provide measurements and data of the wellbore 14, the formation 20, and/or the downhole tool 50. For example, the assembly sensors 54 can include a directional sensor which can determine the direction that the downhole tool 50 is drilling in the formation 20. In some examples, the downhole tool 50 can include a power source 56. The power source 56 can provide power to the components of the downhole tool 50, for example the assembly sensors 54 and/or a motor to actuate the drill tool 52.

It should be noted that while FIG. 1A generally depicts a land-based operation, those skilled in the art would readily recognize that the principles described herein are equally applicable to operations that employ floating or sea-based platforms and rigs, without departing from the scope of the disclosure. Also, even though FIG. 1A depicts a vertical wellbore, the present disclosure is equally well-suited for use in wellbores having other orientations, including horizontal wellbores, slanted wellbores, multilateral wellbores or the like.

The wellhead 30 can include a blowout preventer 36, a stripper 34, and/or an injector 32. The injector 32 can inject the conduit 15 into the wellbore 14. For example, the conduit 15 can be stored on a partition of the split reel 60 and when dispatched, may extend from the reel 60, pass through a guide arch 40, pass through the injector 32, and into the wellbore 14. In other examples, the injector 32 can pull the conduit 15 to retrieve the conduit 15 from the wellbore 14 for storing onto the reel 60. The stripper 34 can provide a pressure seal around the conduit 15 as the conduit 15 is being run into and/or pulled out of the wellbore 14. The blowout preventer 36 can seal, control, and/or monitor the wellbore 14 to prevent blowouts, or uncontrolled and/or undesired release of fluids from the wellbore 14. In other examples, different systems can be utilized based on the type of conduit 15 and/or the environment such as subsea or surface operations.

The reel 60 includes a splitter flange (as shown in FIGS. 2A-3C) to separate a drum core of the reel 60 into a first partition and a second partition. A first conduit may be wound on the first partition of the drum core and a second conduit may be wound on the second partition of the drum core. Coupled to the conduit 15 is a levelwind 70 (discussed further below with reference to FIGS. 2A and 2B) for controlling the winding and unwinding of the conduit 15 from and onto the drum core of the reel 60. In at least one example, a conduit handling system 80 may be disposed proximal to the reel 60 to assist in coupling of the first conduit to the second conduit, as discussed further below with reference to FIG. 4. As shown in FIG. 1A, the conduit handling system 80 may include a telescoping base, attached to the reel 60.

Figure 1B:
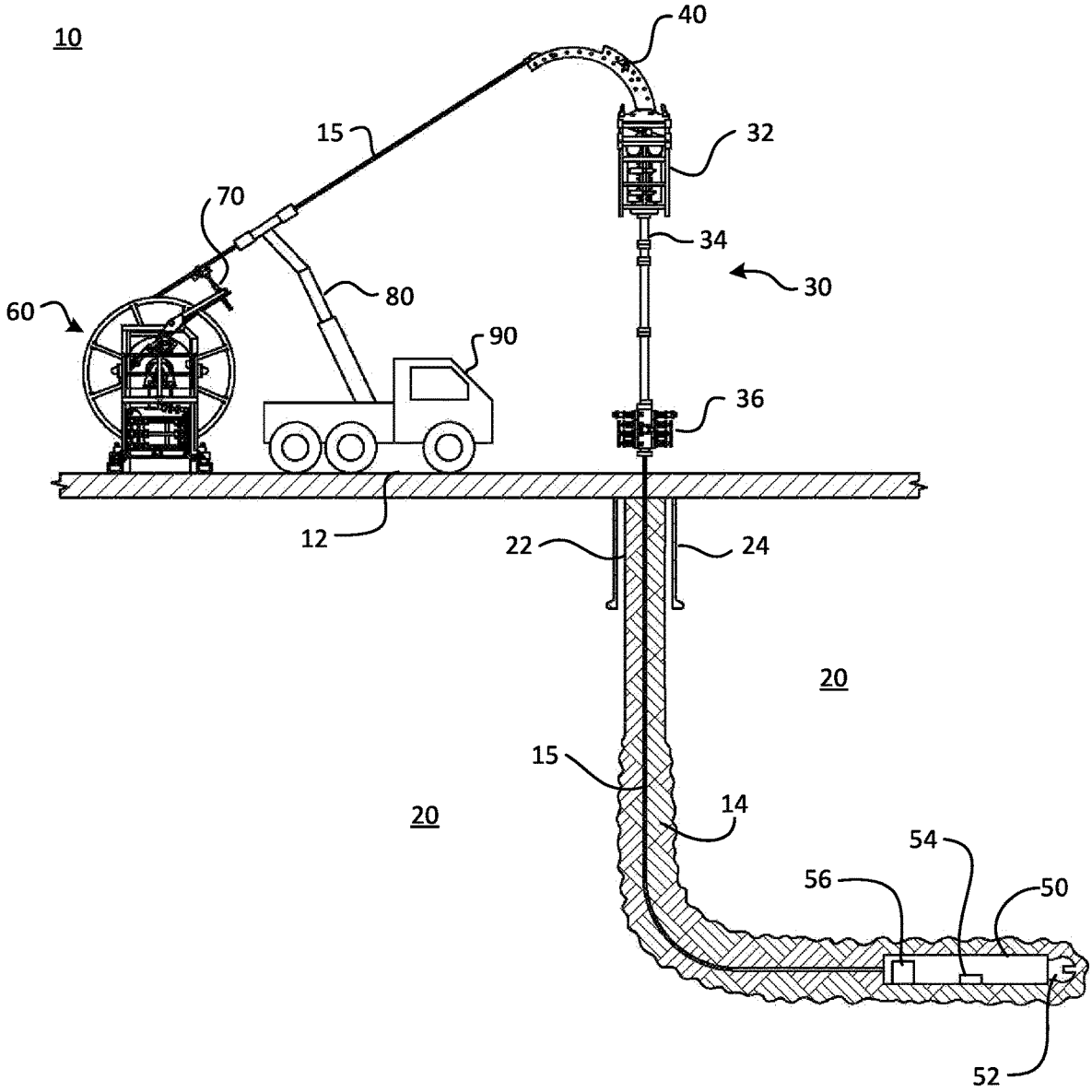
FIG. 1B is a diagram illustrating an exemplary environment for a wellhead utilizing a split reel and conduit handling system, in accordance with various aspects of the subject technology.

FIG. 1B is a diagram illustrating an exemplary environment 10 for a wellhead 30 utilizing a split reel 60 and conduit handling system 80, in accordance with various aspects of the subject technology. In at least one example, the conduit handling system 80 may be attached to a vehicle 90 to increase a work area on the surface 12 where the conduit handling system 80 may be located with respect to the conduit 15.

Figure 1C:
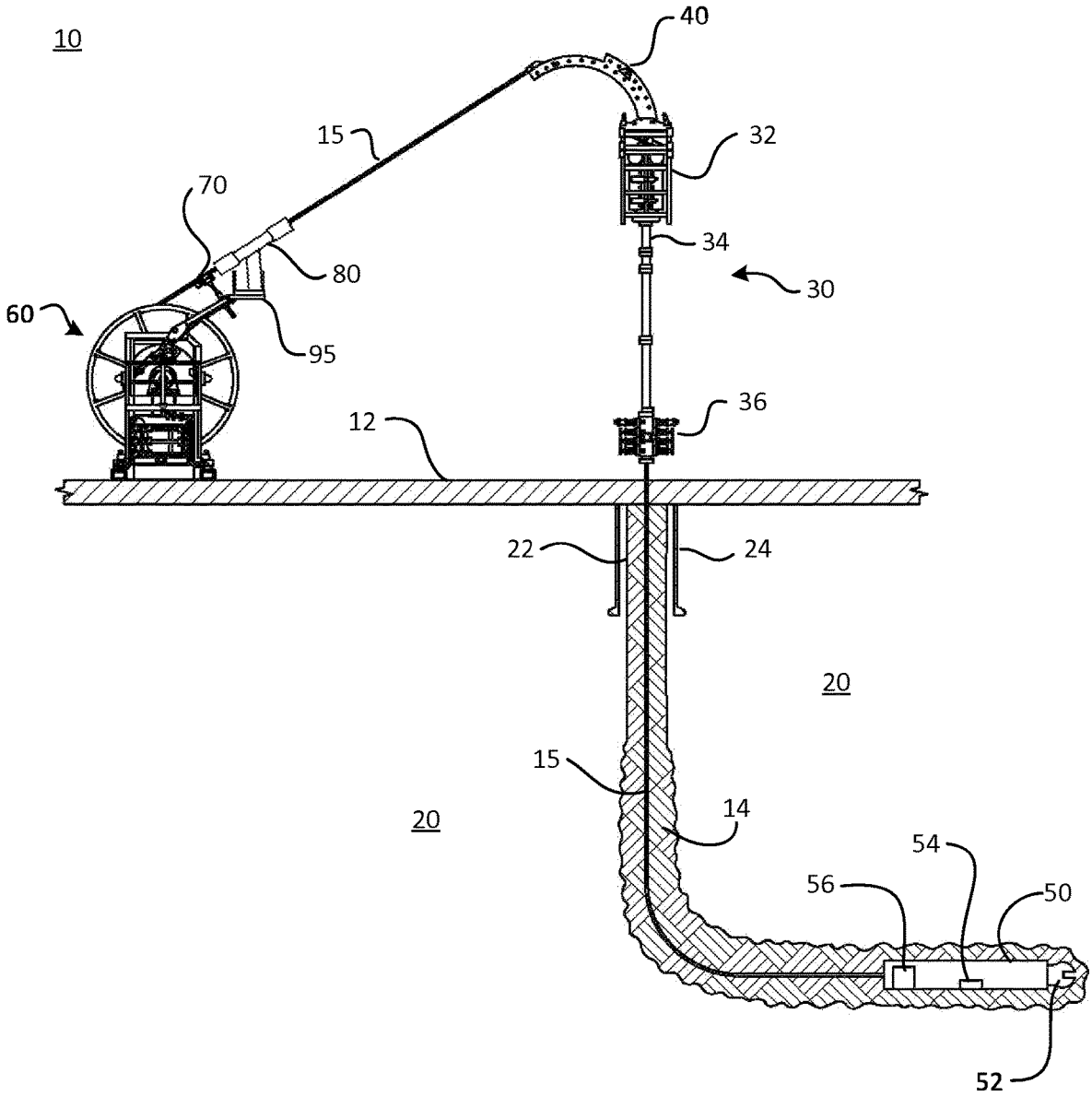
FIG. 1C is a diagram illustrating an exemplary environment for a wellhead utilizing a split reel and conduit handling system, in accordance with various aspects of the subject technology.

FIG. 1C is a diagram illustrating an exemplary environment 10 for a wellhead 30 utilizing a split reel 69 and conduit handling system 80, in accordance with various aspects of the subject technology. As illustrated in FIG. 1C, the conduit handling system 80 may be attached to a scaffold 95 of the reel 60 to enable an operator easy access between the reel 60, levelwind 70, and the conduit handling system 80.

Figure 2A:
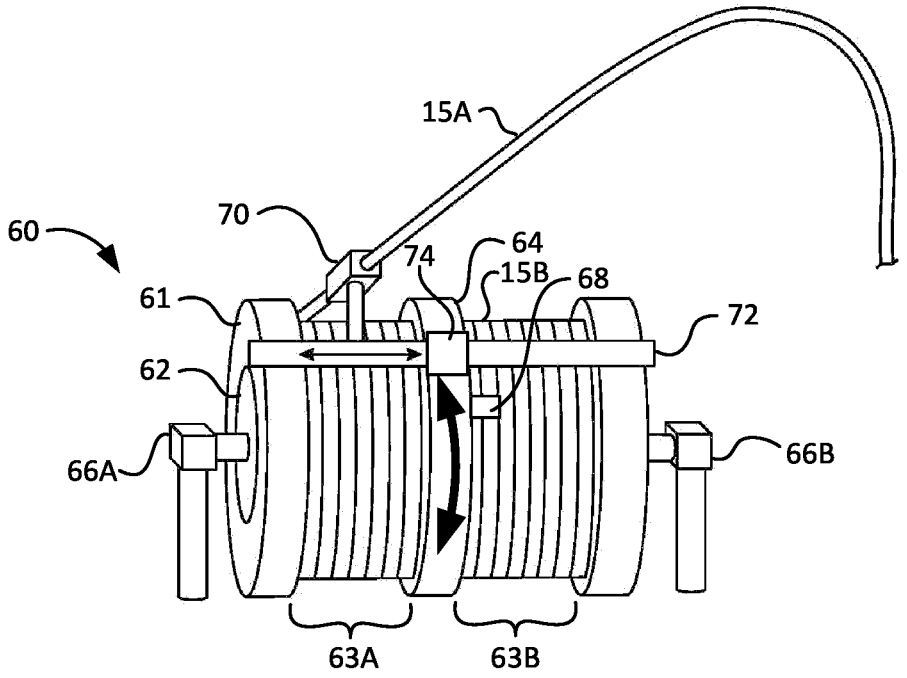
FIG. 2A is a perspective view of a split reel and levelwind, in accordance with various aspects of the subject technology.

FIG. 2A is a perspective view of a split reel 60 and levelwind 70, in accordance with various aspects of the subject technology. The split reel 60 may include a housing 61, a drum core 62 disposed within the housing 61, and a splitter flange 64. The housing 61 may be configured to mechanically support the drum core 62. The drum core 62 is configured to store at least a first conduit 15A and a second conduit 15B thereon. The drum core 62 may have a cylindrical body and may have a plurality of grooves arranged on an outer surface of the drum core 62 that are each configured to receive the conduit 15 therein. The housing 61 may include flanges extending from each end of the drum core 62.

The splitter flange 64 may be disposed on the drum core 62 and may be mechanically attached to the drum core 62 via a clamping engagement whereby the splitter flange 64 surrounds the drum core 62 and is held in place via a clamping force. Alternatively, the splitter flange 64 may be fastened to the drum core 62 using fasteners, such as adhesive, nuts and bolts, screws, threading, etc. As discussed with reference to FIGS. 3A-3C, the splitter flange 64 may be aligned to be on-center with the drum core 62, off-center with respect to the drum core 62, or may include a first and second splitter flange, 64A and 64B respectively.

In at least one example, the splitter flange 64 separates the drum core 62 into a first partition 63A and a second partition 63B. The first partition 63A is configured to receive, store, and provide the first conduit 15A, and the second partition 63B is configured to receive, store, and provide the second conduit 15B. The first conduit 15A is thus wound on the first partition 63A of the drum core 62, and the second conduit 15B is wound on the second partition 63B of the drum core 62. The first conduit 15A and the second conduit 15B may have different sizes (e.g., length, diameter, etc.) and/or may be of different types (e.g., logging coiled tubing, milling coiled tubing, cabling, etc.). As such, the split reel 60 is configured to store and provide separate and different conduits, 15A and 15B respectively, to the wellhead 30.

In some examples, because the split reel 60 includes the first partition 63A to store the first conduit 15A and the second partition 63B to store the second conduit 15B, the split reel 60 may also include a first swivel seal assembly 66A and a second swivel seal assembly 66B. The first and second swivel seal assemblies, 66A and 66B respectively, are each configured to provide fluid to the corresponding conduit 15A and 15B, as required, via a pressure containing rotational joint that allows plumbing to be attached to a side of the split reel 60 without hindering rotation of the split reel 60.

The levelwind 70 is coupled to the split reel 60. The levelwind 70 is configured to guide the first conduit 15A and the second conduit 15B off or on the drum core 62, as the first conduit 15A and the second conduit 15B are unwound from or wound onto the drum core 62. In at least one example, the levelwind 70 may travel along a track 72 that spans across the first partition 63A and the second partition 63B. The track 72 may include a worm gear that extends across the reel 60. In the example illustrated in FIG. 2A, travel of the levelwind 70 along the track 72 may be limited to an active partition (e.g., first partition 63A or second partition 63B) of the drum core 62. For example, the travel of the levelwind 70 may be limited to an active partition (e.g., first partition 63A or second partition 63B) of the reel 60 by adjusting a stop 74 disposed on the track 72.

In operation, the stop 74 may be positioned between the first and second partitions, 63A and 63B respectively, to maintain the levelwind 70 within the first partition 63A. As the first conduit 15A is unwound, the levelwind 70 will slide back and forth on the track 72 within the first partition 63A to feed the first conduit 15A off of the reel 60 in a controlled manner. Thereafter, when it is time to use the second conduit 15B, the stop 74 may be removed from the track 72 to allow the levelwind 70 to slide to the second partition 63B. The stop 74 may be reinstalled between the first and second partitions, 63A and 63B respectively, to maintain the levelwind 70 within the second partition 63B. In some examples, the levelwind 70 may be detached to be moved to the second partition 63B. As the second conduit 15B is unwound, the levelwind 70 will slide back and forth on the track 72 within the second partition 63B to feed the second conduit 15B off of the reel 60 in a controlled manner.

In at least one example, the split reel 60 may also include a lock 68 that is configured to secure a free end of the first or second conduit, 15A or 15B respectively, against the reel 60 to ensure that the free end of the first or second conduit, 15A or 15B respectively, does not inadvertently unwind from the drum core 62 as an active conduit is being unwound from the reel 60.

Figure 2B:
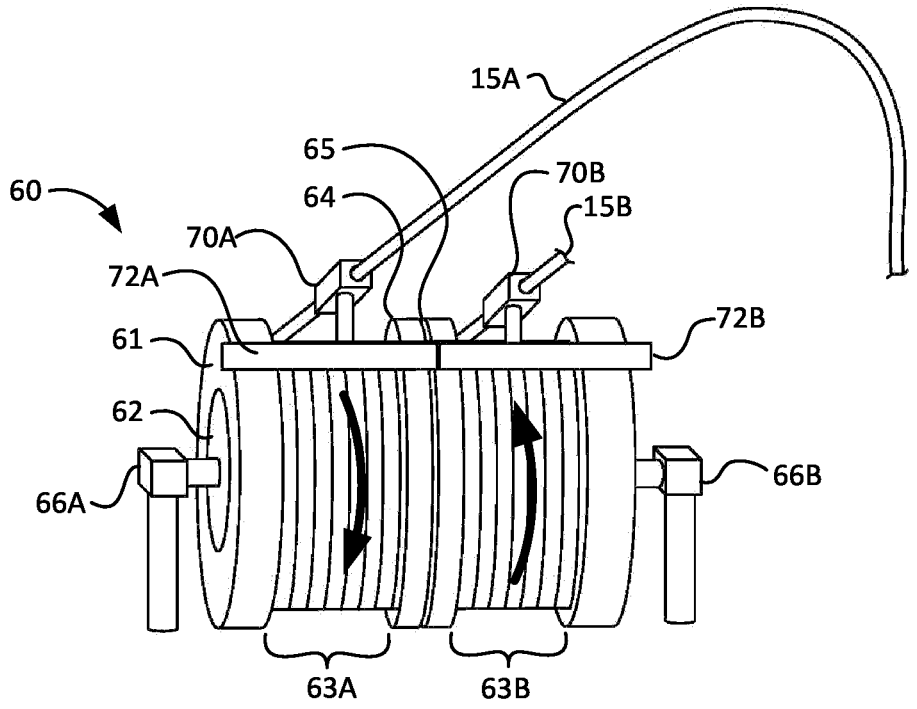
FIG. 2B is a perspective view of a split reel, a first levelwind, and a second levelwind, in accordance with various aspects of the subject technology.

FIG. 2B is a perspective view of a split reel 60, a first levelwind 70A, and a second levelwind 70B, in accordance with various aspects of the subject technology. In at least one example, the splitter flange 64 may include a clutch 65 that is configured to permit the first partition 63A and the second partition 63B to rotate independently. In the illustrated configuration of FIG. 2B, the drum core 62 may include a first drum core corresponding to the first partition 63A and a second drum core corresponding to the second partition 63B. The first drum core is configured to store or deploy the first conduit 15A and the second drum core is configured to store or deploy the second conduit 15B. In other words, the clutch 65 enables independent control of each drum core.

In at least one example, the reel 60 may include a first and second levelwind, 70A and 70B respectively. The first levelwind 70A is configured to guide the first conduit 15A off or on the drum core 62, as the first conduit 15A is unwound from or wound onto the drum core 62. The second levelwind 70B is configured to guide the second conduit 15B off or on the drum core 62, as the second conduit 15B is unwound from or wound onto the drum core 62. In some examples, the number of levelwinds 70A, 70B can correspond with the number of drum cores 62 or partitions. In some examples, the number of levelwinds can be different than the number of drum cores or partitions. The first levelwind 70A may travel along a first track 72A that spans across the first partition 63A. The second levelwind 70B may travel along a second track 72B that spans across the second partition 63B. The first and second tracks, 72A and 72B respectively, may each include a worm gear that extends across their respective partitions, 63A and 63B respectively.

In operation, one or both of the first conduit 15A and the second conduit 15B may be deployed into the wellbore, as desired. If the first conduit 15A is desired to be deployed first, the first conduit 15A is unwound from the drum core 62, passes through the first levelwind 70A, and, in at least one example, is directed to the wellhead, for example by the guide arch. As the first conduit 15A is unwound from the first partition 63A, the second partition 63B may remain stationary. The first levelwind 70A will slide back and forth on the first track 72A within the first partition 63A to feed the first conduit 15A off of the reel 60 in a controlled manner. Thereafter, when it is time to use the second conduit 15B, the first drum core stops rotating and the second drum core begins rotating to deploy the second conduit 15B into the wellhead. The second conduit 15B is unwound from the drum core 62, passes through the second levelwind 70B, and is directed to the wellhead by the guide arch. As the second conduit 15B is unwound from the second partition 63B, the first partition 63A may remain stationary. The second levelwind 70B will slide back and forth on the second track 72B within the second partition 63B to feed the second conduit 15B off of the reel 60 in a controlled manner.

Figure 3A:
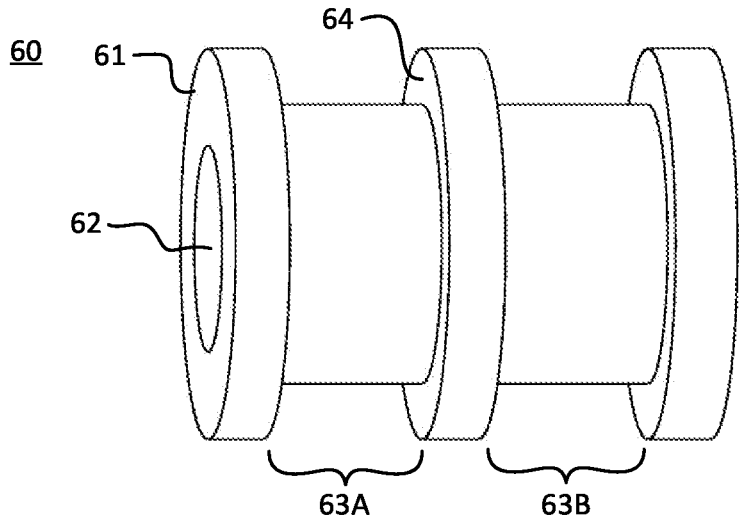
FIG. 3A is a perspective view of a reel drum with a splitter flange, in accordance with various aspects of the subject technology.
Figure 3B:
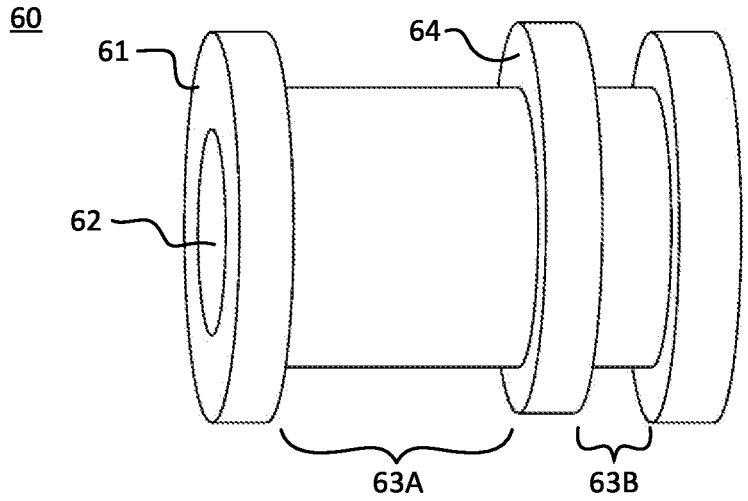
FIG. 3B is a perspective view of a reel drum with a splitter flange, in accordance with various aspects of the subject technology.
Figure 3C:
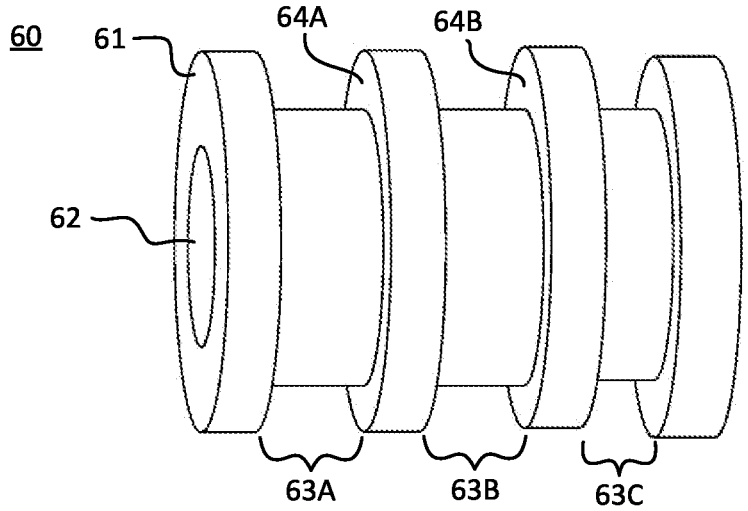
FIG. 3C is a perspective view of a reel drum with a plurality of splitter flanges, in accordance with various aspects of the subject technology.

FIGS. 3A-3C illustrate perspective views of a reel 60 with a splitter flange 64, in accordance with various aspects of the subject technology. Referring to FIG. 3A, the reel 60 includes the splitter flange 64 mounted on-center with respect to the drum core 62. The splitter flange 64 separates the drum core 62 into the first partition 63A and the second partition 63B. Referring to FIG. 3B, the reel 60 includes the splitter flange 64 mounted off-center with respect to the drum core 62. The splitter flange 64 separates the drum core 62 into the first partition 63A and the second partition 63B. As such, a width of the first partition 63A is wider than a width of the second partition 63B. In some examples, a length of the first conduit 15A associated with the first partition 63A can be longer than a length of the second conduit 15B associated with the second partition 63B. In some examples, the diameter of the first conduit 15A associated with the first partition 63A can be greater than the diameter of the second conduit 15B associated with the second partition 63B. Referring to FIG. 3C, the reel 60 includes a first splitter flange 64A and a second splitter flange 64B. The first splitter flange 64A separates the drum core 62 into the first partition 63A and the second partition 63B. The second splitter flange 64B separates the drum core 62 into the third partition 63C. A width of the first partition 63A may be different from a width of the second partition 63B. A width of the third partition may be different from the first partition 63A and/or the second partition 63B. In at least one examples, the number of partitions and the number of flanges can be adjusted to accommodate the number and/or size of conduits as desired.

Figure 4:
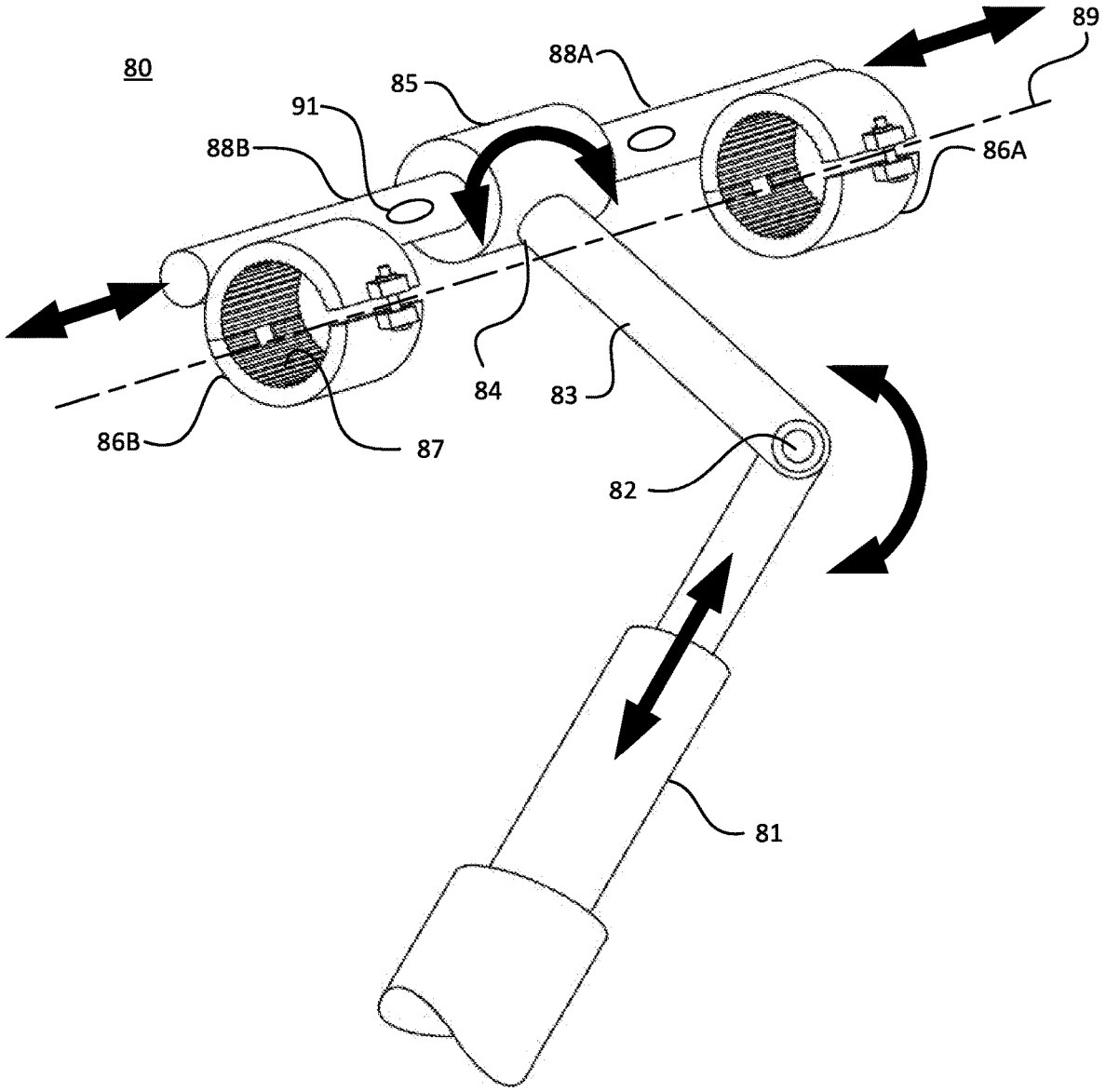
FIG. 4 is a perspective view of a conduit handling system, in accordance with various aspects of the subject technology.

FIG. 4 is a perspective view of a conduit handling system 80, in accordance with various aspects of the subject technology. The conduit handling system 80 may include a telescoping base 81, a first pivoting joint 82, an arm 83, a second pivoting joint 84, and/or a head assembly 85. The conduit handling system 80 is configured to mechanically restrain a conduit, or in some examples, ends of two conduits to facilitate coupling between the two conduits. In some examples, the conduit handling system 80 can mechanically restrain any number of desired conduits. Specifically, the conduit handling system 80 is configured to provide an operator with versatile adjustment via the telescoping base 81, first pivoting joint 82, and the second pivoting joint 84, to enable the conduit handling system 80 to easily align ends of the conduits.

The head assembly 85 may include a first clamp 86A configured to mechanically support an end of the first conduit 15A, and a second clamp 86B configured to mechanically support an end of the second conduit 15B. The first and second clamps, 86A and 86B respectively, may be configured to apply a clamping force on a corresponding outer surface of the first conduit 15A and second conduit 15B, to enable coupling of the first conduit to the second conduit. To aid in gripping the outer surfaces of the first conduit 15A and the second conduit 15B, a friction surface 87 (e.g., rubber pad or slips) may line an interior of the first and second clamps, 86A and 86B respectively. In another example, the interior of the first and second clamps, 86A and 86B respectively, may each include an expansion surface that is configured to reduce an inner diameter of the first and second clamps, 86A and 86B respectively, to increase a contact area and force acting against an outer surface of the corresponding conduit.

In operation, an operator may secure an end of the first conduit 15A within the first clamp 86A to prevent the first conduit 15A from moving further into the wellbore. Securing the end of the first conduit 15A to prevent movement also aids in attaching a connector or coupler to the end of the first conduit 15A. The operator may then secure an end of the second conduit 15B within the second clamp 86B to prevent the second conduit 15B from moving away from the first conduit 15A. Securing the end of the second conduit 15B to prevent movement also aids in attaching the connector or coupler to the end of the second conduit 15B.

In some examples, the head assembly 85 may further include a first actuator 88A coupled to the first clamp 86A and a second actuator 88B coupled to the second clamp 86B. In at least one example, the first actuator 88A and the second actuator 88B may be configured to apply a compressive force along a longitudinal axis 89 on the first conduit 15A and the second conduit 15B to connect the first conduit 15A with the second conduit 15B. The compressive force may be applied on the first and/or second conduits, 15A and 15B respectively, to push the first conduit 15A and/or the second conduit 15B towards each other to get them to connect to one another. In some examples, the first actuator 88A and the second actuator 88B may each configured to apply a tensile force along the longitudinal axis 89 on the first conduit 15A and the second conduit 15B to test the connection between the first conduit 15A and the second conduit 15B. The tensile force applied on the first and second conduits, 15A and 15B respectively, may be applied in opposing directions. The first and second actuators, 88A and 88B respectively, may include hydraulic cylinders that when pressurized, apply a separating or joining force at a junction between the first and second conduits, 15A and 15B respectively, to test the coupling between the two conduits or to join the two conduits.

In operation, an operator may test the integrity of a connection between the first conduit 15A and the second conduit 15B by applying a separating or tensile force on ends of the first conduit 15A and the second conduit 15B to determine whether the connection is adequate. The operator may secure the end of the first conduit 15A adjacent to a coupler/connector within the first clamp 86A, and may secure the end of the second conduit 15B adjacent to the coupler/connector within the second clamp 86B. A tensile or separating force may then be applied via the first and second actuators, 88A and 88B respectively, to the ends of the conduit, 15A and 15B, to test the integrity of the connection between the first conduit 15A and the second conduit 15B.

In some examples, a sensor 91 may be mounted to the first actuator 88A and/or the second actuator 88B to measure an amount of load being applied against the connector. The sensor 91 may be configured to measure at least one of a strain, load, and force acting on the connector. The sensor 91 may include at least one of a load cell and a strain gauge. The sensor 91 may be communicatively coupled to a processor to provide data representing one of at least a strain, load, and force acting on the connector. The processor may be configured to receive the data from the sensor 91, process the data from the sensor 91, and/or determine whether a predetermined threshold has been surpassed, indicating that the connection between the first conduit 15A and the second conduit 15B is adequate.

Figure 5:
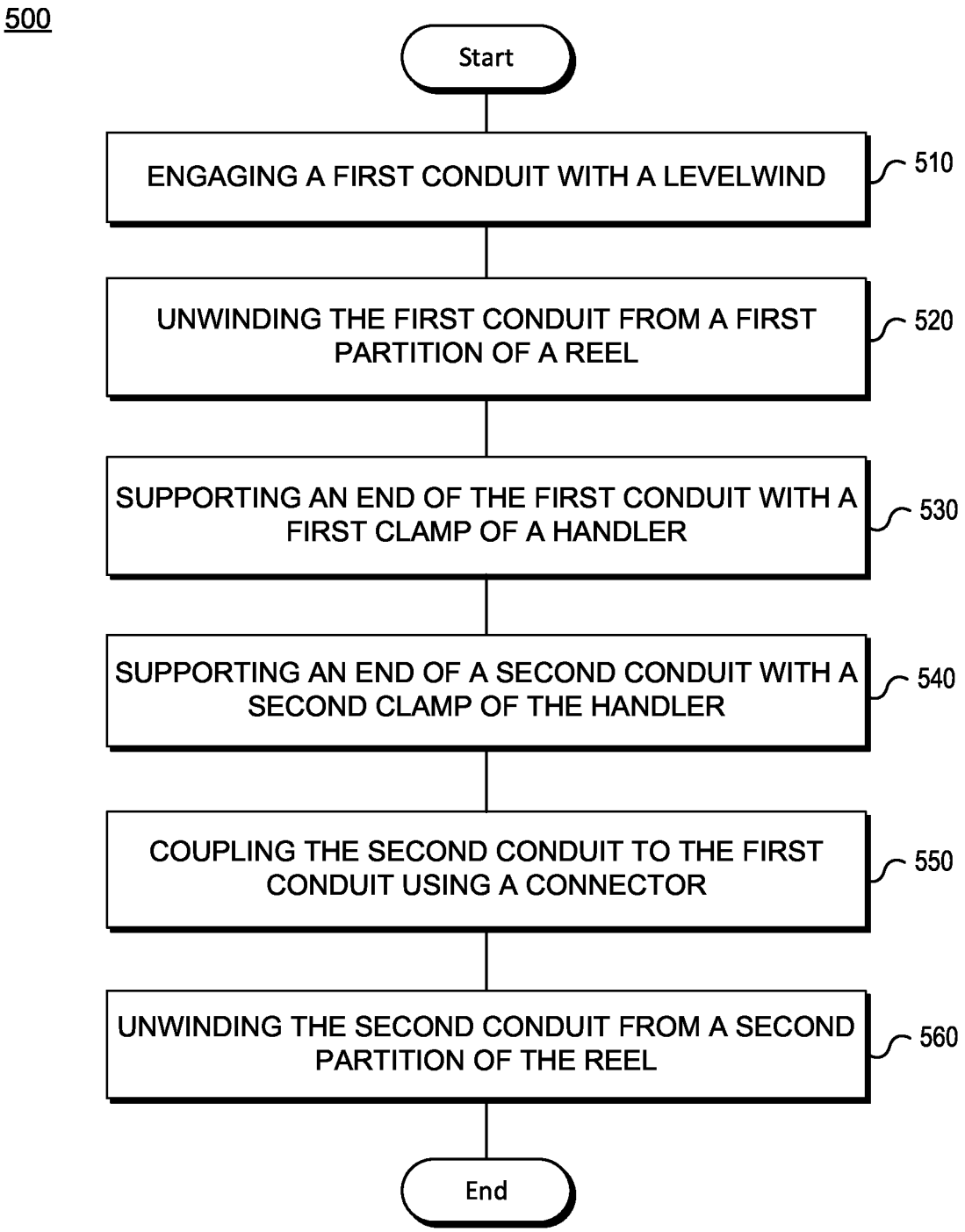
FIG. 5 is an example method for providing a first conduit and a second conduit to a wellhead, in accordance with various aspects of the subject technology.

FIG. 5 is an example method 500 for providing a first conduit and a second conduit to a wellhead, in accordance with various aspects of the subject technology. The method 500 is provided by way of example, as there are a variety of ways to carry out the method. The method 500 described below can be carried out using the configurations illustrated in FIGS. 1A-4, for example, and various elements of these figures are referenced in explaining example method 500. Each block shown in FIG. 5 represents one or more processes, methods or subroutines, carried out in the example method 500. Furthermore, the illustrated order of blocks is illustrative only and the order of the blocks can change according to the present disclosure. Additional blocks may be added or fewer blocks may be utilized, without departing from this disclosure. The method 500 can begin at block 510.

At block 510, a first conduit is engaged with a levelwind to assist in unwinding the first conduit from a reel. The first conduit may include coiled tubing or cabling that is configured for use in a wellhead. The reel has a drum core disposed within a housing, and a splitter flange separating the drum core into a first partition and a second partition. In at least one example, the first partition of the reel and the second partition of the reel are each configured to rotate independently. The first conduit is wound on the first partition of the drum core, and a second conduit is wound on the second partition of the drum core. At block 520, the first conduit is unwound from the first partition of the reel. In at least one example, the first conduit may be fully unwound from the first partition of the reel. In some examples, the first conduit may be partially unwound from the first partition of the reel At block 530, an end of the first conduit is supported with a first clamp of a handler. At block 540, an end of the second conduit is supported with a second clamp of the handler. At block 550, the second conduit is coupled to the first conduit using a connector. In some examples, the first conduit may be coupled with the second conduit without being supported with a first and second clamp. At block 560, the second conduit is unwound from the second partition of the reel.

The method may also include engaging the second conduit with a second levelwind. The method may further include applying a pulling force using a first actuator acting upon the first conduit and a second actuator acting upon the second conduit, the pulling force configured to test a connection between the first conduit and the second conduit. The method may also include detecting an amount of pulling force applied on the first conduit and the second conduit using a sensor.

Numerous examples are provided herein to enhance understanding of the present disclosure. A specific set of statements are provided as follows.

Statement 1: A reel assembly comprising: a housing; a drum core disposed within the housing; a splitter flange separating the drum core into a first partition and a second partition; a first conduit wound on the first partition of the drum core; and a second conduit wound on the second partition of the drum core.

Statement 2: A reel assembly is disclosed according to Statement 1, wherein the reel assembly further includes a levelwind to guide the first conduit and the second conduit off of the drum core as the first conduit and the second conduit are unwound from the drum core.

Statement 3: A reel assembly is disclosed according to Statements 1 or 2, wherein the reel assembly further includes a first levelwind to guide the first conduit off of the drum core as the first conduit is unwound from the drum core, and a second levelwind to guide the second conduit off of the drum core as the second conduit is unwound from the drum core.

Statement 4: A reel assembly is disclosed according to any of preceding Statements 1-3, wherein the reel assembly further includes a lock to secure an end of at least one of the first conduit and the second conduit to prevent the first conduit or the second conduit from unwinding from the drum core.

Statement 5: A reel assembly is disclosed according to any of preceding Statements 1-4, wherein a length of the first conduit is longer than a length of the second conduit.

Statement 6: A reel assembly is disclosed according to any of preceding Statements 1-5, wherein a width of the first partition is wider than a width of the second partition.

Statement 7: A reel assembly is disclosed according to any of preceding Statements 1-6, wherein the splitter flange includes a clutch to permit the first partition and the second partition to rotate independently.

Statement 8: A reel assembly is disclosed according to any of preceding Statements 1-7, wherein the reel assembly further includes a handler including: a first clamp to mechanically support the first conduit, and a second clamp to mechanically support the second conduit, wherein the first clamp and the second clamp are used to couple the first conduit to the second conduit.

Statement 9: A reel assembly is disclosed according to any of preceding Statements 1-8, wherein the handler further includes a first actuator coupled to the first clamp; a second actuator coupled to the second clamp; wherein the first actuator and the second actuator are each configured to apply at least one of a tensile force and compressive force on the first conduit and the second conduit, respectively.

Statement 10: A wellhead system is disclosed comprising: a reel assembly comprising: a housing; a drum core disposed within the housing; a splitter flange separating the drum core into a first partition and a second partition; a first conduit wound on the first partition of the drum core; a second conduit wound on the second partition of the drum core; and a wellhead operable to guide the first conduit and the second conduit into a wellbore.

Statement 11: A wellhead system is disclosed according to Statement 10, wherein the reel assembly further includes a levelwind to guide the first conduit and the second conduit off of the drum core as the first conduit and the second conduit are unwound from the drum core.

Statement 12: A wellhead system is disclosed according to Statements 10 or 11, wherein the reel assembly further includes: a first levelwind to guide the first conduit off of the drum core as the first conduit is unwound from the drum core; and a second levelwind to guide the second conduit off of the drum core as the second conduit is unwound from the drum core.

Statement 13: A wellhead system is disclosed according to any of preceding Statements 10-12, wherein the splitter flange includes a clutch to permit the first partition and the second partition to rotate independently.

Statement 14: A wellhead system is disclosed according to any of preceding Statements 10-13, further comprising a handler including: a first clamp to mechanically support the first conduit, and a second clamp to mechanically support the second conduit, wherein the first clamp and the second clamp are used to couple the first conduit to the second conduit.

Statement 15: A wellhead system is disclosed according to any of preceding Statements 10-14, wherein the handler further includes: a first actuator coupled to the first clamp; a second actuator coupled to the second clamp; wherein the first actuator and the second actuator are each configured to apply at least one of a tensile force and compressive force on the first conduit and the second conduit, respectively.

Statement 16: A method for providing a first conduit and a second conduit to a wellhead is disclosed, the method comprising: engaging a first conduit with a levelwind; unwinding the first conduit from a first partition of a reel; supporting an end of the first conduit with a first clamp of a handler; supporting an end of a second conduit with a second clamp of the handler; coupling the second conduit to the first conduit using a connector; and unwinding the second conduit from a second partition of the reel.

Statement 17: A method is disclosed according to Statement 16, further comprising: engaging the second conduit with a second levelwind.

Statement 18: A method is disclosed according to Statements 16 or 17, wherein the first partition of the reel and the second partition of the reel are each configured to rotate independently.

Statement 19: A method is disclosed according to any of preceding Statements 16-18, further comprising: testing a connection between the first conduit and the second conduit by applying a pulling force using a first actuator acting upon the first conduit and a second actuator acting upon the second conduit.

Statement 20: A method is disclosed according to any of preceding Statements 16-19, further comprising: detecting, by a sensor, an amount of pulling force applied on the first conduit and the second conduit.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A conduit handling apparatus comprising:

a telescoping base;

an arm pivotally coupled to the telescoping base on a first end of the arm; and a head assembly pivotally coupled to a second end of the arm, the head assembly including more than one clamp and is configured to at least restrain at least two conduits and to couple ends of the at least two conduits.

2. The conduit handling apparatus of claim 1, wherein the head assembly further comprises at least two actuators and wherein the at least two actuators are configured to elongate from each side of the head assembly.

3. The conduit handling apparatus of claim 2, wherein the more than one clamp is positioned on the at least two actuators to support the ends of the at least two conduits.

4. The conduit handling apparatus of claim 3, wherein an interior surface of the more than one clamp further comprises a lining of frictional surface.

5. The conduit handling apparatus of claim 3, wherein the more than one clamp further comprises an expansion surface configured to reduce an inner diameter of the more than one clamp.

6. The conduit handling apparatus of claim 2, further comprising at least one sensor positioned on the at least two actuators to measure an amount of load being applied against a connection between the at least two conduits.

7. The conduit handling apparatus of claim 6, wherein the load comprises at least one of a tensile and compressive strain and force.

8. A conduit handling system comprising:

a conduit handling apparatus including:

a telescoping base, an arm pivotally coupled to the telescoping base, and a head assembly pivotally coupled to a non-telescoping base end of the arm, the head assembly including more than one clamp and is configured to at least restrain at least two conduits and to couple ends of the at least two conduits; and a reel assembly including:

a housing, and a drum core disposed within the housing and containing at least one conduit.

9. The conduit handling system of claim 8, wherein the head assembly further comprises at least two actuators and wherein the at least two actuators are configured to elongate from each side of the head assembly.

10. The conduit handling system of claim 9, wherein the more than one clamp is positioned on the at least two actuators to support the ends of the at least two conduits.

11. The conduit handling system of claim 10, wherein an interior surface of the more than one clamp further comprises a lining of frictional surface.

12. The conduit handling system of claim 10, wherein the more than one clamp further comprises an expansion surface configured to reduce an inner diameter of the more than one clamp.

13. The conduit handling system of claim 9, further comprising at least one sensor positioned on the at least two actuators to measure an amount of load being applied against a connection between the at least two conduits.

14. The conduit handling system of claim 13, wherein the load comprises at least one of a tensile and compressive strain and force.

15. A method comprising:

engaging a first conduit with a first clamp of a conduit handling apparatus, wherein the conduit handling apparatus comprises:

a telescoping base;

an arm pivotally coupled to the telescoping base on a first end of the arm; and a head assembly pivotally coupled to a second end of the arm, wherein the head assembly is configured to at least restrain at least two conduits and to couple ends of the at least two conduits;

engaging a second conduit with a second clamp of the conduit handling apparatus; and coupling the second conduit to the first conduit using a connector.

16. The method of claim 15, wherein the conduit handling apparatus comprises at least two actuators configured to elongate from each side of the head assembly.

17. The method of claim 16, further comprising engaging one of the least two actuators of the conduit handling apparatus to apply at least a compressive force or a tensile force on the connector between the first conduit and the second conduit.

18. The method of claim 16, wherein the first clamp and the second clamp are positioned on the least two actuators to support the ends of the first conduit and second conduit.

19. The method of claim 15, wherein an interior surface of the first and second clamps further comprises a lining of frictional surface.

20. The method of claim 15, wherein the first and second clamps further comprise an expansion surface configured to reduce an inner diameter of the first and second clamps.

* * * * *